US007946423B2

(12) United States Patent
Gupta

(10) Patent No.: US 7,946,423 B2
(45) Date of Patent: May 24, 2011

(54) PORTABLE WORKSTATION

(75) Inventor: Nikhil Gupta, Schaumburg, IL (US)

(73) Assignee: DPG USA Inc., Schaumburg, IL (US)

( * ) Notice: Subject to any disclaimer, the term of this patent is extended or adjusted under 35 U.S.C. 154(b) by 147 days.

(21) Appl. No.: 12/008,593

(22) Filed: Jan. 11, 2008

(65) Prior Publication Data

US 2008/0169219 A1 Jul. 17, 2008

(51) Int. Cl.
*B65D 1/34* (2006.01)
*B65D 6/04* (2006.01)

(52) U.S. Cl. ..... 206/564; 206/566; 206/574; 206/6.1; 206/471; 220/526; 220/213

(58) Field of Classification Search ..... 206/564, 206/566, 574, 6.1, 471; 220/526, 213
See application file for complete search history.

(56) References Cited

U.S. PATENT DOCUMENTS

| | | | | |
|---|---|---|---|---|
| 3,666,087 | A * | 5/1972 | Cooper | 206/470 |
| 4,016,972 | A * | 4/1977 | Szamborski | 206/6.1 |
| 5,540,324 | A * | 7/1996 | Knapp | 206/6.1 |
| 2005/0211138 | A1 * | 9/2005 | Gupta | 108/43 |
| 2005/0279745 | A1 * | 12/2005 | Gupta | 220/23.4 |

OTHER PUBLICATIONS

Advertisement for the Straight Line Bead Board With Removable Lid, Darice Inc., 2004 Strongsville, OH 44149.

* cited by examiner

*Primary Examiner* — J. Gregory Pickett
*Assistant Examiner* — Blain G Neway
(74) *Attorney, Agent, or Firm* — Robert S. Alexander

(57) ABSTRACT

A portable workstation for beadcrafting operations is provided. The workstation includes a base including at least one receptacle for holding parts such as beads, preferably in a desired pattern. A cover interfittable with the base includes a seal portion that engages and surrounds the receptacle so as to maintain the parts in their desired position, despite movement of the workstation.

25 Claims, 2 Drawing Sheets

PORTABLE WORKSTATION

FIELD OF INVENTION

This invention relates to portable workstations for working on craft and hobby projects such as bead stringing or bead weaving, while supporting the projects on the user's lap.

BACKGROUND OF THE INVENTION

It has been found convenient to support projects, such as beadwork projects on a simple support, such as holding the project in the user's lap. In this way, the projects can be enjoyed in a wide variety of informal settings, with a minimum of extra time required for equipping an area with a more formal work place. As those familiar with beadcrafting and other similar activities are aware, the raw materials required for a project are usually supplied in bulk quantity, with different types of materials being segregated one from the other. For example, bead weaving or bead stringing may require beads of different colors, sizes and shapes. Bead trays and holders, such as those described in U.S. Pat. Nos. 5,636,743 and 6,571,955 are helpful in keeping the different work pieces separate, while making the work pieces readily available to a user.

Several problems have been observed with informal lap-supported workstations. Accidental spills arising in a transportation environment or due to incidental contact with pets or children can require a considerable time investment to correct. The need has thus arisen for a system for organizing different groupings of small parts while providing convenient storage in between work sessions. Also, it is desirable to package a craft project with materials used later to provide a lap support for assembling the project.

SUMMARY OF THE INVENTION

The present invention provides a novel and improved portable workstation that provides advantages over the construction, mode of operation and use of prior art work aids, while minimizing the disadvantages associated with such items. One embodiment of a portable workstation according to principles of the present invention arranges and maintains parts in a grouping, despite movement of the workstation. The workstation includes a base with a base body and at least one receptacle, such as a channel or a compartment, offset from the base body for holding the parts. The base body has a border surrounding the receptacle. A cover includes a cover body and at least one offset portion that is offset from the cover body, and that is surrounded by a border. The border of the base body engages the border of the cover body so as to maintain the receptacle spaced from the offset portion while confining the parts within the receptacle despite movement of the portable workstation.

In another embodiment, multiple groups of parts are maintained in separate groupings, despite movement of the workstation. In this embodiment, the base includes a plurality of receptacles offset from the base body, each surrounded by a border, and the cover includes a plurality of offset portions, each surrounded by their respective borders. The borders of the base body engage the borders of the cover body so as to maintain the receptacles spaced from the offset portions while separating contents of the receptacles, despite movement of the portable workstation.

Several variations are possible. For example, the receptacles formed in the base and the offset features formed in the cover may define a channel to arrange parts in a linear series or a compartment for holding a bulk quantity of parts. The cover offset portion may be either convex or concave. The cover may interfit with the base, and may be transparent so as to enable viewing of the parts without disturbing their groupings. If desired, locks, such as snap locks, can be provided to maintain secure engagement of the cover and base. The cover and base may be provided with stiffening features to ensure confinement of the parts within respective channels and compartments when the cover and base are snapped together, even if the workstation is moved or tipped on its side.

DESCRIPTION OF PREFERRED EMBODIMENTS

Figure 1:
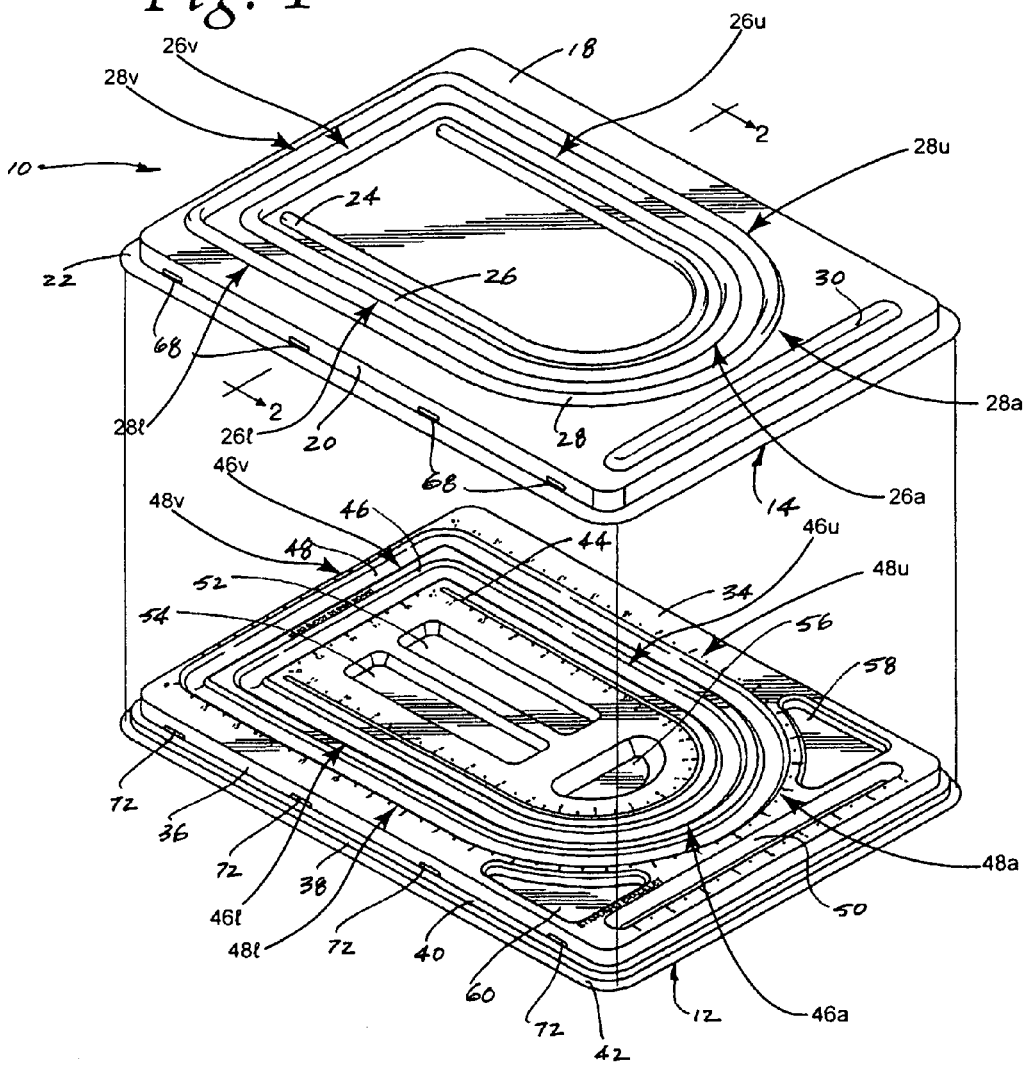
FIG. 1 is an exploded perspective view of a portable workstation.

The invention disclosed herein is, of course, susceptible of embodiment in many different forms. Shown in the drawings and described hereinbelow in detail are preferred embodiments of the invention. It is understood, however, that the present disclosure is an exemplification of the principles of the invention and does not limit the invention to the illustrated embodiments.

Moreover, for ease of description, a portable workstation embodiment of the present invention is described below in its usual assembled position as shown in the accompanying drawings and terms such as upper, lower, horizontal, longitudinal, etc. may be used herein with reference to this usual position. However, the portable workstation may be manufactured, transported, sold or used in orientations other than that described and shown herein.

Referring now to the drawings and initially to FIG. 1, the portable workstation 10 is particularly suitable for activities involving relatively large numbers of small sized parts, such as beads which must be assembled together by stringing, or in some other manner. The portable workstation according to principles of the present invention should be desirable to beadcrafters engaged in activities such as bead weaving and bead stringing. Workstation 10 includes a base 12 and a cover 14.

Preferably, the base and cover are each monolithically formed of molded plastic or other suitable material. Alternatively, construction materials such as sheet metal, paper and hybrid combinations of paper and other materials could also be used. If desired, one or more coatings can be applied to the base or cover. For example, the base may be covered with a flock material. It is a generally preferred, however, that at least the cover 14 is made of transparent material, and left uncoated. Further, it is generally preferred that the cover 14 be made of sufficiently thick material so as to be relatively rigid when formed in the fashion illustrated. It is generally preferred that cover 14 and base 12 be formed of thermoplastic material that is vacuum formed to provide a number of features that are employed to add functionality as well as rigidity to the base 12, as well as the cover 14.

As can be seen in FIG. 1, the base 12 of workstation 10, and the cover 14 have a generally rectangular shape, although other shapes may be used, as desired. Also, workstation 10 has a relatively small thickness or height compared to its surface dimensions, although the workstation could be made to other proportions. As shown in the Figures, cover 14 has a generally flat planar body 18 that extends to the outer periphery of the cover. A sidewall 20 depends from body 18 and is terminated with an outwardly extending flange 22. Preferably, the sidewall 20 and flange 22 have rounded edges. A spaced apart series of upraised channels 24-30 are offset, i.e. set above cover body 18. In the illustrated embodiment, channels 24-28 are nested one within the other, and channel 30 is positioned to one side of the channels 24-28, adjacent the bottom edge of the workstation.

Referring again to FIG. 1, base 12 has a generally flat planar body 34 that extends generally to the outer periphery of the base. A sidewall 36 depends from body 34 and is terminated with an outwardly extending stepped flange 38 having inner and outer horizontal stepped surfaces 40, 42. Preferably, the sidewall 36 and stepped flange 38 have rounded edges. As can be seen, for example, in FIG. 3, stepped flange 38 provides a cushioning or shock absorbing for base 12. This prevents parts carried on base 12 from becoming dislodged with a slight bumping inadvertently applied to the base.

Base 12 has a number of features, preferably different types of receptacles, all of which are preferably offset below base body 34. For example, receptacles in the form of channels 44-48 are spaced-apart and nested one within another and channel 50 is separately located, adjacent the workstation bottom edge. In addition, receptacles in the form of compartments 52, 54 are located at the center. of the workstation, adjacent a third compartment 56. Corner compartments 58, 60 are located adjacent ends of channel 50, at the workstation bottom edge. It is generally preferred that all of the channels 44-50 and the compartments 52-60 be separated one from the other by intervening peripheral surfaces which, in the preferred embodiment, comprise portions of base body 34. If desired, base 12 can be provided with intervening body structures that do not lie in a common plane.

It is generally preferred that the channels and compartments provide different types of organization for the workpieces or parts employed by a user. For example, workstation 10 is useful in the field of bead crafting. Bulk quantities of various working parts, such as different size and color beads, chain links and string elements must be accommodated while various parts are assembled in a work in progress. It is important that a user be allowed to interrupt an ongoing project without concern as to whether the parts may unintentionally become mixed together, as might occur if the workstation is accidentally bumped or otherwise disturbed. Although not necessary, it is generally preferred that the channels be sized and shaped to arrange given parts in a linear series, ready for assembly. For example, it has been found helpful to allow a user to arrange parts in a trial pattern or linear series, prior to stringing. As can be seen, for example, in FIGS. 2 and 3, the channels 44-50 have rounded bottom portions and rounded sidewalls that direct beads placed therein to become arranged in a linear series. Accordingly, compartments 52-60 are conveniently located nearby to provide a ready supply of beads and other working parts.

Figure 2:
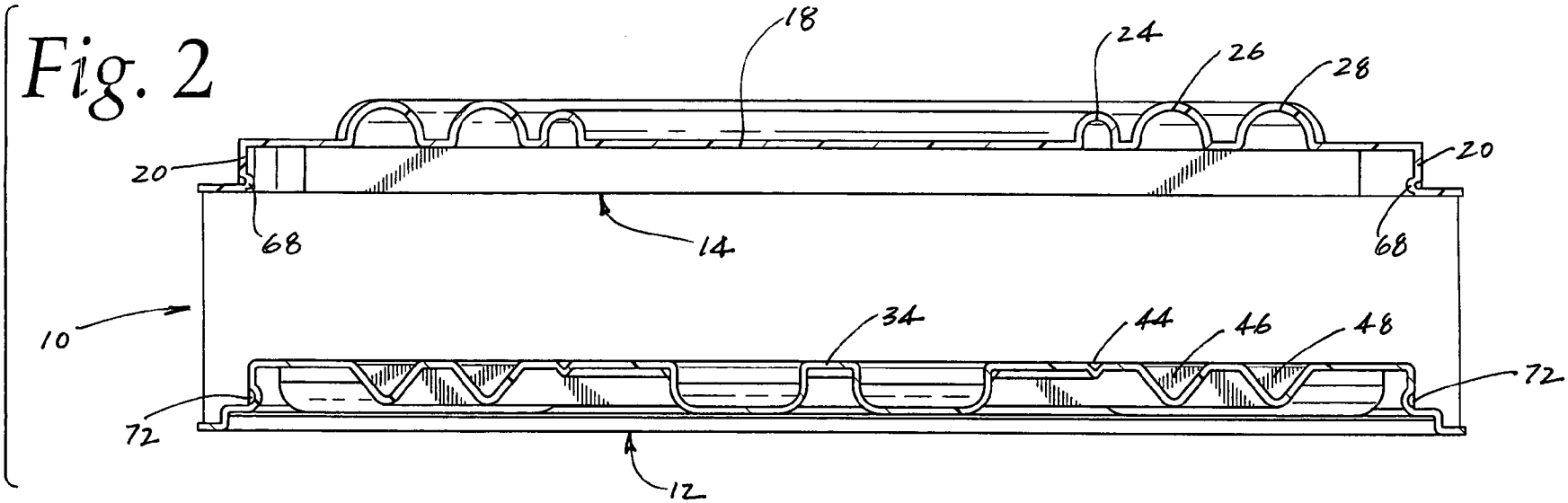
FIG. 2 is a cross-sectional view taken along the line 2-2 of FIG. 1.
Figure 3:
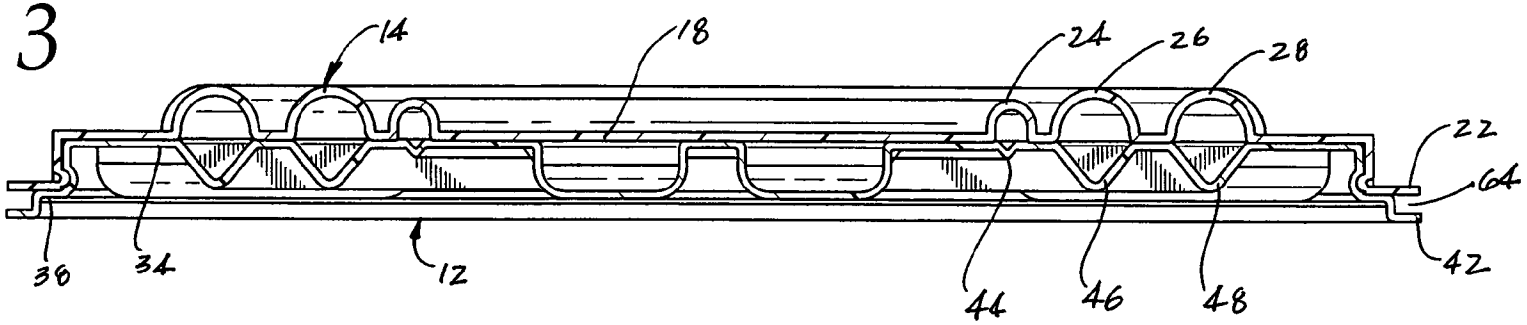
FIG. 3 is a cross-sectional view similar to that of FIG. 2, but showing the portable workstation fully assembled.

As mentioned, it is generally preferred that the channels be maintained separate one from the other, and from the compartments, as well. As can be seen in FIG. 2, channels 44-48 are separated by portions of base body 34. Thus, the contents of each channel are separately confined. Additional confinement is also provided by cover 14, when the cover is engaged with the base, as shown in FIG. 3, so as to superimpose cover channels 24-28 over base channels 44-48 to thereby form spaced apart tubular enclosures or workstation channels. As indicated in FIG. 3, it is generally preferred that, with the cover 14 and base 12 interengaged, the base body 34 engages the cover body 18 so as to surround each base channel and each base compartment with a sealed or enclosed perimeter, to form enclosed workstation channels and compartments. In this manner, the contents of each workstation channel and each workstation receptacle are separately confined, preventing their intermingling one with the other, despite movement of the assembled workstation.

In order to quickly and easily maintain alignment of the cover channels and base channels, and to ensure that substantially the entire periphery of each channel and compartment is adequately enclosed or sealed, workstation 10 includes features for registering the cover 14 with the base 12, in the desired manner. For example, it was mentioned that the cover and the base have rounded corners. It is generally preferred that the radius of curvature for the cover and base complement one another, and that one, such as the base, be dimensioned for internesting within the other. In addition, sidewalls 20, 36 provide guiding surfaces as the cover and the base are interengaged, and horizontal surface 40 of stepped flange 38 provides a stop when engaged with flange 22 of cover 14. As can be seen in FIG. 3, a gap 64 is located between flange 22 and step surface 42, to easily allow the fully engaged cover and base to be pulled apart, for opening the workpiece.

If desired, the channels of the cover and base can be sized similarly, although it is generally preferred that the channels be made to have different cross-sectional sizes so as to accommodate a variety of differently sized parts, ensuring a well defined array for loose parts inserted therein. The channels of the cover are generally rounded to accommodate rounded beads without pinching. In contrast, the channels of the base are less rounded, with straight sidewalls and a smaller radius, but still rounded, bottom wall. This feature provides a trapping of rounded beads within the base channel, quickly bringing the beads to an extended centerline position, as desired.

As can be seen in the drawing, the work station of FIG. 1 comprises a base 12 having a plurality of curved, nested, spaced-apart channels 44, 46, 48 and a plurality of compartments 52, 54, 56, 58 and 60. In this embodiment, the curved base channels are substantially U-shaped with curved portions extending substantially across the smaller dimension of the generally rectangular base. U-shaped base channel 44 forms an open "U". Other U-shaped base channels form closed paths, e.g. 48. Recessed compartments 52, 54 and 56 are disposed within the closed path. The base channels and compartments are sealed by a single removable cover 14. The cover 14 can be separated from the base 12 for use of the base as a beading workstation on a beader's lap. The cover can be reattached to the base.

As can be seen for example in FIG. 1, a series of locks or inwardly raised lock tabs 68 are located about the periphery of cover sidewall 20. The lock tabs are received in depressions or detents 72 formed in base sidewall 36 with a snap fit, providing a snap lock for the cover and base. With lock tabs 68 engaged with detents 72, body 18 of cover 14 is maintained in contact with body 34 of base 12, ensuring a seal, preferably a continuous seal for the periphery of each channel and compartment of the workstation. Referring to FIGS. 2 and 3, it can be seen that the lock tabs 68 are rounded, as are the detents 72. This is important during opening of the workstation, to avoid a sudden release of stored energy that might disrupt the workstation contents. As will be appreciated by those skilled in the art, cover sidewall 20 provides an inward bias force to lock tabs 68. This bias force can be adjusted, for example, by adjusting the thickness of the cover sidewall to further ensure a secure engagement of the cover and base, but without a jerky or sudden energy release upon opening of the workstation. It should be noted in this regard, that the relatively large size of the flange 22 and the step surface 42 which cooperate to form gap 64 (see FIG. 3) add substantially to the control of forces occasioned when cover 14 is separated from base 12.

As mentioned, it is generally preferred that the cover and base be made substantially rigid, thus adding to the ensured enclosure of the workstation channels and compartments. The presence of offset features such as the channels 24-30 of cover 14 and the channels 44-50 and compartments 52-60 of the base further adds to the desired rigidity, especially when the cover and base are molded, using vacuum forming or other techniques. In particular, in FIG. 1, it should be noted that linear channel 50 extends transversely across the width of one of the ends of base 12 while matching linear channel 30 extends transversely across the corresponding end of cover 14. Further, internested "D"-shaped channels 46 and 48 comprise longitudinally extending linear portions 46*u*, 46*l* and 48*u*, 48*l* spanning substantially the length of base 12, while vertical uprights 46*v* and 48*v* of the internested "D"s extend linearly across and span substantially the width of the end of base 12 opposite linear groove 50 and arcuate portions 46*a* and 48*a* of internested "D"-shaped channels 46 and 48 are disposed adjacent linear channel 50. Similarly, the corresponding structures of internested "D"-shaped channels 24 and 26 are formed in cover 14 with longitudinally extending linear portions 26*u*, 26*l* and 28*u*, 28*l* spanning substantially the length of cover 14, while vertical uprights 26*v* and 28*v* of the internested "D"s extend linearly across and span substantially the width of the end of cover 14 opposite linear groove 30 and arcuate portions 26*a* and 28*a* of internested "D"-shaped channels 24 and 26 are disposed adjacent linear channel 30. It can therefore be appreciated that each of base 12 and cover 14 have linear reinforcing channels extending both transversely and longitudinally substantially across both their length and their breadth. Although internested channel features have been described, other arrangements are also possible. For example, adjacent channels need not have similar shapes. If desired, additional locks could be provided within the interior of the cover and the base, although this has not been found to be necessary.

Other and further configurations, modifications and embodiments of the present invention will be apparent to those skilled in the art from the present teachings and disclosures. The present invention is not limited to the present illustrative embodiments. Changes can be made therein without departing from the spirit and scope of the invention.

What is claimed is:

1. A portable bead workstation for arranging and maintaining beading supplies and projects on a user's lap, the workstation comprising:

a base having a base surface, the base surface defining a plurality of curved, spaced-apart channels, each having a substantially semi-circular and concave cross-section sized and shaped to arrange beads in a linear series, said plurality of channels including: a linear channel extending transversely across the width of one end of said base; at least one "D"-shaped channel, said "D"-shaped channel having:

an upper and a lower longitudinally extending linear portion spanning substantially the length of said base and a generally linear vertical upright extending across and spanning substantially the width the end of said base opposite said linear channel; and an arcuate portion disposed adjacent said linear channel;

a separable cover matingly engageable with the base and having a cover surface, the cover surface defining a plurality of cover channels corresponding to the base channels such that, when the base and cover are engaged with one another, the cover channels and base channels define tunnels suitable for maintaining the beading supplies and projects in said linear series, said plurality of cover channels including: a linear cover channel extending transversely across the width of one end of said cover; at least one "D"-shaped cover channel, said "D"-shaped channel having:

an upper and a lower longitudinally extending linear portion spanning substantially the length of said cover and a linear vertical upright extending linearly across and spanning substantially the width the end of said cover opposite said linear channel; and an arcuate portion disposed adjacent said linear cover channel;

the channels defined in said base being less rounded, having straight sidewalls and a rounded bottom wall having a smaller radius than the channels defined in said cover;

the base further defining a base border portion substantially circumscribing the base surface, the base border portion having a vertically extending sidewall having a plurality of spaced apart rounded locking sites formed therein; and the cover further defining a cover border portion having a vertically extending cover sidewall depending therefrom, substantially circumscribing the cover surface, the cover sidewall having a plurality of spaced apart rounded locking sites defined on its interior surface, each said cover locking site being engageable with a base locking site, the locking site on one of said base and said cover comprising a protrusion, the locking site on the other of said base and said cover defining a depression , wherein when the base and the cover are engaged with one another, the base locking sites engage with the cover locking sites and detachably secure the base to the cover such that, upon engagement of the separable cover with the base, the tunnels defined therebetween do not communicate with one another.

2. The portable bead workstation of claim 1, wherein said cover channels substantially define semi-circular and concave cross-sections.

3. The portable bead workstation of claim 1, wherein each base locking site defines a substantially concave channel and each cover locking site is adapted to mate with a base locking site.

4. The portable bead workstation of claim 1, wherein a width of each of said plurality of base channels is substantially the same as a width of each of said plurality of cover channels where each said base channel and each said cover channel are proximate to one another.

5. The portable bead work station according to claim 1 wherein:

the base is a rigid base suitable for resting on a user's lap and further comprises a plurality of recessed base compartments;

the plurality of recessed base compartments comprises base compartments for storing bulk quantities of beading supplies, the base compartments disposed adjacent the base channels; and the separable cover comprises a single cover for sealing the base channels and the base compartments when the work station is not in use to keep beading supplies and arranged linear groupings in their respective compartments and channels.

6. The portable bead workstation according to claim 1 wherein the cover is substantially transparent.

7. The portable bead work station of claim 5 wherein one or more of the recessed compartments are circumscribed within the "D"-shaped channel.

8. The portable bead workstation of claim 1 wherein the cover comprises transparent material.

9. The portable bead portable beading station of claim 1 wherein the base and the cover are separate monolithic bodies of vacuum formed thermoplastic material.

10. A portable bead workstation for arranging and maintaining beading supplies and projects in a grouping on a user's lap, comprising:

a base including a base body and at least one receptacle offset from the base body for holding the beading supplies, the receptacle defining an upwardly open channel, the base body further including a border surrounding the receptacle;

a separable and reattachable cover including a cover body and at least one offset portion offset from the cover body, the cover body further including a border surrounding the offset portion, the offset portion defining a downwardly open channel being so located as to be superposed over said upwardly open channel when said cover body is aligned over said base body thereby defining a tunnel coextensive with said channels in said base and cover; and the border of the base body engaging the border of the cover body so as to maintain each receptacle spaced from each offset portion while confining parts within the receptacle and tunnel despite movement of the portable workstation, the channels defined in each of said base and said cover having linear reinforcing portions extending both transversely and longitudinally substantially across both the length and the breadth of said cover and said base, said channels arranged to provide a plurality of tunnels therebetween, each channel defined in said base being less rounded, having straight sidewalls and a rounded bottom wall having a smaller radius than each channel defined in said cover, said tunnels not communicating with each other so that the contents of each workstation tunnel and each workstation receptacle are separately confined preventing intermingling thereof despite movement of the assembled workstation.

11. The portable bead workstation according to claim 10 wherein the receptacle and the offset portion defines a channel for holding the beading supplies when mated with one another.

12. The portable bead workstation according to claim 10 wherein the cover is interfittable with the base.

13. The portable bead workstation according to claim 10 wherein the cover offset portion is concave.

14. The portable bead workstation according to claim 10 wherein the receptacle is concave.

15. The portable bead workstation according to claim 10 wherein the cover is substantially transparent.

16. The portable bead workstation according to claim 10 wherein:

the base includes a plurality of receptacles offset from the base body, each receptacle surrounded by a border; a cover including plurality of offset portions, each offset portion surrounded by a border; and the borders of the base body engaging the borders of the cover body as to maintain the receptacles spaced from the offset portions while separating contents of the receptacles despite movement of the portable workstation.

17. The portable bead workstation according to claim 10 wherein:

the base is a rigid base suitable for resting on a user's lap and comprises a plurality of open channels and a plurality of recessed base compartments;

the plurality of base channels comprise a plurality of curved, nested spaced-apart channels for maintaining linear groupings of beading supplies or projects;

the plurality of recessed base compartments comprises base compartments for storing bulk quantities of beading supplies, the base compartments disposed adjacent the base channels; and the separable and retractable cover comprises a single cover for sealing the base channels and the base components when the work station is not in use to keep beading supplies and arranged linear groupings in their respective compartments and channels.

18. The portable bead work station of claim 10 wherein the base channels comprise at least substantially U-shaped portions with curved portions extending substantially across the width of the base.

19. The portable bead work station of claim 18 wherein one of the base channels forms an open path.

20. The portable bead workstation of claim 18 wherein one of the base channels forms a closed path.

21. The portable bead work station of claim 17 wherein one or more of the recessed base compartments are disposed within the closed path.

22. The portable bead workstation of claim 10 wherein the cover comprises transparent material.

23. A portable beading workstation for arranging and maintaining beading supplies and projects for use on a users lap and for storing the supplies and projects when not in use comprising:

a generally rectangular base having a base surface with a plurality of recessed receptacles for beading supplies and a plurality of recessed curved channels for assembling and storing beading projects, the curved channels comprising at least one reinforcing "D"-shaped groove extending substantially the length of the rectangular base and spanning substantially across the width of the base;

a generally rectangular lid for engagement over the base surface comprising a lid surface including flat regions for covering the receptacles when the cover is engaged and at least one outwardly recessed reinforcing "D"-shaped groove corresponding to a reinforcing "D"-shaped groove of the base to form respective tunnels for storing the beading projects when the lid is engaged, the channel defined in said base being less rounded, having straight sidewalls and a rounded bottom wall having a smaller radius than the channels defined in said cover;

wherein the base and the lid are separate monolithic bodies of vacuum formed thermoplastic.

24. The portable beading station of claim 23 wherein the base comprises a generally flat planar body having a peripheral sidewall that is terminated with an outwardly extending stepped flange having inner and outer horizontal stepped surfaces.

25. The portable beading station of claim 24 wherein the lid comprises a peripheral sidewall with a peripheral flange, the sidewall of the lid engageable with the sidewall of base, and the flange of the cover stopped by the inner horizontal stepped surface of the base to leave an open space between the flange of the lid and the outer horizontal stepped surface of the base flange.

* * * * *